United States Patent [19]

Rudick

[11] Patent Number: 4,866,949

[45] Date of Patent: Sep. 19, 1989

[54] CARBONATED LIQUID REFRIGERATION SYSTEM

[75] Inventor: Arthur G. Rudick, Marietta, Ga.

[73] Assignee: The Coca-Cola Company, Atlanta, Ga.

[21] Appl. No.: 271,325

[22] Filed: Nov. 15, 1988

[51] Int. Cl.[4] ..... F25D 23/02

[52] U.S. Cl. ..... 62/307; 62/119; 62/338; 62/393

[58] Field of Search ..... 62/119, 306, 307, 338, 62/389, 391, 393, 394, 395, 396

[56] References Cited

U.S. PATENT DOCUMENTS

| | | | |
|---|---|---|---|
| 2,095,008 | 10/1937 | Phelipp | 62/393 X |
| 3,021,685 | 2/1962 | Gore et al. | 62/393 X |
| 3,834,178 | 9/1974 | Pink | 62/338 |
| 3,914,957 | 10/1975 | Jacobs | 62/338 |
| 3,982,406 | 9/1976 | Hanson et al. | 62/396 X |
| 4,003,214 | 1/1977 | Schumacher | 62/340 |
| 4,355,522 | 10/1982 | Gorski et al. | 62/340 |
| 4,739,629 | 4/1988 | True | 62/389 X |

*Primary Examiner*—William E. Tapolcai
*Attorney, Agent, or Firm*—Birch, Stewart, Kolasch & Birch

[57] ABSTRACT

A separate refrigeration system in a conventional refrigerator for dispensing a chilled carbonated liquid such as water or a beverage from the front door of the refrigerator and is comprised of a refrigerator having a freezer compartment wherein there is located a condenser. The condenser is interconnected with a combined evaporator-carbonator unit located in the front door. The freezer compartment accordingly acts as a heat sink for the condenser. The evaporator unit being integral with the carbonator, operates to chill the carbonator. When desirable, the condenser and evaporator can be replaced by a liquid heat transfer system having a heat absorbing coil assembly located in the carbonator and a heat dissipating coil assembly in the freezer compartment or by a constant temperature heat pipe having its heat dissipating end located in the freezer compartment while its heat absorbing end is located in the carbonator.

15 Claims, 2 Drawing Sheets

CARBONATED LIQUID REFRIGERATION SYSTEM

BACKGROUND OF THE INVENTION

The present invention relates generally to refrigeration apparatus for home refrigerator-freezer units and more particularly to a refrigeration system for the carbonator apparatus of a post-mix beverage dispenser mountable in the door of a conventional home refrigerator.

In recent years, home refrigerators have been designed to dispense chilled products such as ice, water and beverages through the front doors when the doors are shut. Not only is this a convenience to the home owner, but it also acts to save energy by reducing the number of times that the doors must be opened and closed. To be effective and useful, any front door dispensing system should be simple so that it can be easily built into or retrofitted into a refrigerator door. Furthermore, it must be easy to use and efficient in its operation.

SUMMARY OF THE INVENTION

Accordingly, it is the primary object of the invention to provide an improvement in liquid dispensing systems for conventional home refrigerators.

It is another object of the present invention to provide a carbonated liquid dispenser integral with a conventional home refrigerator where the dispensing can be achieved without entry into the refrigerator.

It is a further object of the present invention to provide a system for dispensing a chilled carbonated liquid from a door on the front of the refrigerator.

These and other objects of the present invention are fulfilled by providing a separate refrigeration system in a conventional refrigerator for dispensing a chilled carbonated liquid such as water or a beverage from the front door, and in its preferred form, is comprised of a refrigerator having a freezer compartment wherein there is located a condenser which is connected to combined evaporator-carbonator unit located in the front door of the refrigerator. The freezer compartment acts as a heat sink for the condenser. The evaporator unit being integral with the carbonator, operates to chill the carbonator. When desirable, the condenser and evaporator may be replaced by a liquid heat transfer system having a heat absorbing coil located in the carbonator and heat dissipating coil located in the freezer compartment or by a constant temperature heat pipe having its heat dissipating end located in the freezer compartment while its heat absorbing end is located in the carbonator. An access opening is also provided in the door and a dispenser including a discharge port coupled to the carbonator is located thereat for dispensing the carbonated liquid from the refrigerator while the door is closed.

BRIEF DESCRIPTION OF THE DRAWINGS

The objects of the present invention and the attendant advantages thereof will become more readily apparent by reference to the accompanying drawings, wherein.

DETAILED DESCRIPTION OF THE PREFERRED EMBODIMENTS

Figure 1:
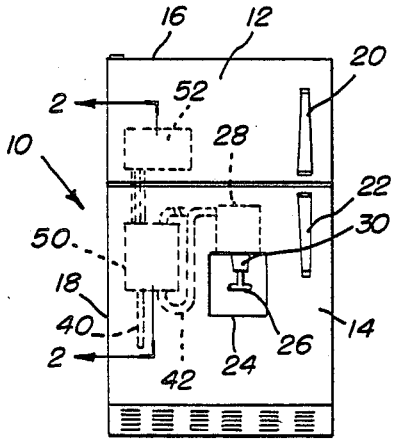
FIG. 1 is a front plan view generally illustrative of a conventional refrigerator having an upper freezer compartment and a lower refrigeration compartment.
Figure 2:
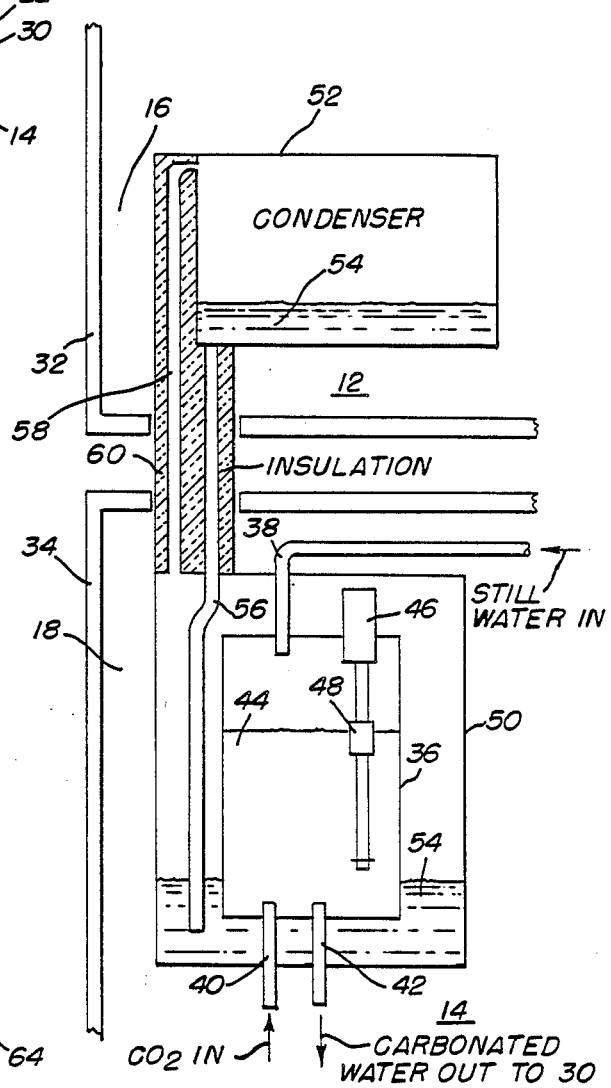
FIG. 2 is a partial cross sectional diagram of the refrigerator shown in FIG. 1 taken along the lines 2—2 thereof and is illustrative of one embodiment of the present invention.

Referring now to the drawings wherein like reference numerals refer to like parts throughout, attention is directed first to FIGS. 1 and 2 where reference numeral 10 denotes a conventional home refrigerator of the type which is comprised of an upper freezer compartment 12 and a lower refrigeration compartment 14, each having hinged doors 16 and 18 which include respective handles 20 and 22 for opening the doors.

The present invention has for its primary objective the generation and delivery of carbonated water or a post-mix carbonated beverage including a mixture of flavor concentrate and carbonated water from one of the front doors of a home refrigerator. In FIG. 1 this is shown being provided from the lower door 14 which includes a generally rectangular access opening or recess 24 wherein a liquid receptacle, not shown, can be inserted therein and pressed against an actuation lever 26 coupled to a liquid dispenser 28 which includes a discharge port 30.

Referring now to FIG. 2 disclosed therein are the details of a first embodiment of the invention. Reference numerals 16 and 18 denote partial cutaway portions of the upper and lower compartment doors 16 and 18. Reference numerals 32 and 34 denote the respective door seals for the doors 16 and 18. Further as shown in FIG. 2, a carbonator unit 36 is located in the body of the door 18 with a still water input conduit 38 connected into the upper portion thereof while a gas conduit 40 for carbon dioxide ($CO_2$), for example, is connected into the bottom of the carbonator. A carbonated water output conduit 42 is also connected into the bottom of the carbonator. In order to maintain the level of the liquid 44, such as water, in the carbonator 36, a liquid level switch 46 is mounted on the carbonator 36 with a float type switch activator 48 extending down into the liquid 44.

It is also desirable that the carbonated water generated in the carbonator 36 and fed to the discharge port 30 (FIG. 1) be cooled or chilled. To this end the carbonator 36 in FIG. 2 is shown being located interiorally of and enveloped by an evaporator unit 50 of a closed cycle refrigerator system separate and apart from the main refrigeration system of the refrigerator 10 and which also includes a condenser 52 located in the freezer compartment 12. Reference numeral 54 denotes liquified refrigerant which pools in the lower portions of both the condenser 52 and the evaporator 50. A pair of refrigerant connecting lines or tubes 56 and 58 interconnect the condenser 52 and the evaporator 50 with the tube 56 being the tube for delivering liquified refrigerant by gravity from the condenser 52 to the evaporator 50 while the tube 58 returns refrigerant in its gaseous state back to the top portion of the condenser 52. The freezer compartment 12 which is typically at 0 F. (−17.8 C), provides a heat sink for the condenser 52 which is situated in and is thus thermally coupled thereto.

Figure 3:
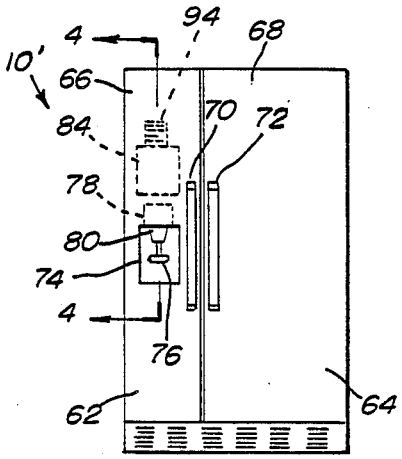
FIG. 3 is a front plan view generally illustrative of a home refrigerator having full length freezer and refrigerator compartments.

Turning attention now to FIG. 3, shown thereat is a home refrigerator 10' where the freezer compartment 62 and the refrigerator compartment 64 are arranged in side-by-side relationship and having full length doors 66 and 68 which are adapted to be opened by respective handles 70 and 72. An access opening 74 is provided in the freezer door 66 and includes an actuator 76 located therein and being connected to a liquid dispenser 78 having a discharge port 80. Whereas in the embodiment shown in FIG. 1, where the dispenser and evaporator elements are located in the refrigeration compartment door 18, all of the components are now located on the freezer side of the refrigerator 10', thus leaving the refrigeration compartment door 64 free of the dispenser. The details of the apparatus shown in FIG. 3 are disclosed in FIG. 4.

Figure 4:
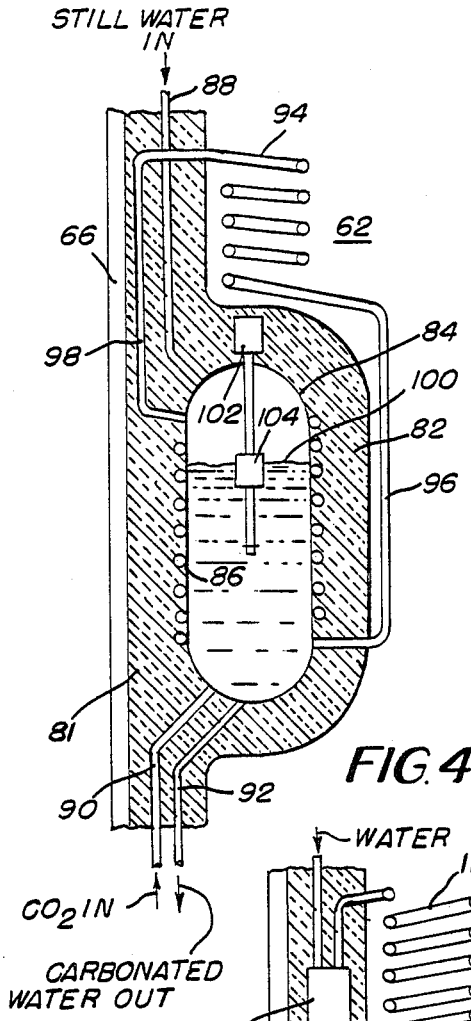
FIG. 4 is a partial cross sectional diagram of the refrigerator shown in FIG. 3 taken along the lines 4—4 thereof and is illustrative of another embodiment of the invention.

Referring now to FIG. 4, reference numeral 81 denotes the insulation material which is located on the rear side of the freezer door 66 of FIG. 3. The insulation 81 includes a thickened region 82 which includes a cavity for the location of an elongated carbonator unit 84 therein and which is surrounded by evaporator means comprised of a plurality of tubular coils 86 which extend along the length of the carbonator 84. Alternatively, the coil 86 can be located inside the carbonator. As before, a still water inlet conduit 88 couples into the upper portion of the carbonator 84 for the introduction of $H_2O$ into the interior thereof while a pair of conduits 90 and 92 couple into the lower portion of the carbonator where conduit 90, for example, supplies $CO_2$ from a source, not shown, into the lower portion thereof while carbonated water is fed out to the dispenser apparatus 78 via the conduit 92.

The evaporator coil assembly 86 is coupled to a condenser 94 comprised of a coil assembly which is located within the confines of the freezer compartment 62 so that the freezer compartment again acts as a heat sink for the refrigeration system including the evaporator coil assembly 86. The evaporator 86 and condenser 94 are interconnected by a pair of tubular elements 96 and 98 which feed through the freezer door insulation 81. In order to maintain the level of the liquid 100 in the carbonator unit 84 at a predetermined level an electrical switch 102 activated by a float mechanism 104 extending down into the interior of the carbonator is provided in order to regulate the flow of the still water into the carbonator via a valve, not shown, coupled to the inlet conduit 88.

The insulation thickness in the region 82 surrounding the carbonator 84 is selectively chosen so that the temperature of the carbonator will stabilize at about 40° F. (4.4° C.) under normal conditions. The refrigerant used in the system is also selected to have a boiling point of about 32° F. (0° C). With the condensed refrigerant returning to the evaporator coil assembly 86 by gravity from the condenser coil assembly 94, chilled carbonated liquid, water or beverage, can be dispensed from the door discharge port 80.

Figure 5:
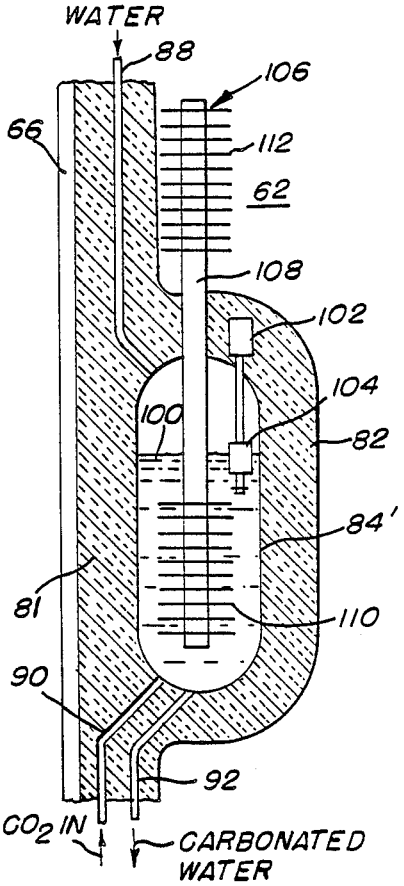
FIG. 5 is a partial cross sectional diagram illustrative of a modification of the embodiment shown in FIG. 4.

A modification of the refrigeration system for the carbonator 84 is shown in FIG. 5 and involves substitution of a constant temperature heat pipe assembly 106 for the evaporator-condenser combination shown in FIG. 4. The constant temperature heat pipe 106 is shown mounted on a carbonator unit 84' and comprises an elongated body member wherein heat is transmitted from a lower set of heat transfer fins 110 located inside of the carbonator 84' to a upper set of heat transfer fins 112 located in the freezer compartment 62. The heat pipe assembly is configured such that the heat pipe will stop transmitting heat if the temperature inside the carbonator 84' drops to 32° F.(0° C.). This type of apparatus is well known in the art and is readily obtainable and thus can be employed when desirable.

Figure 6:
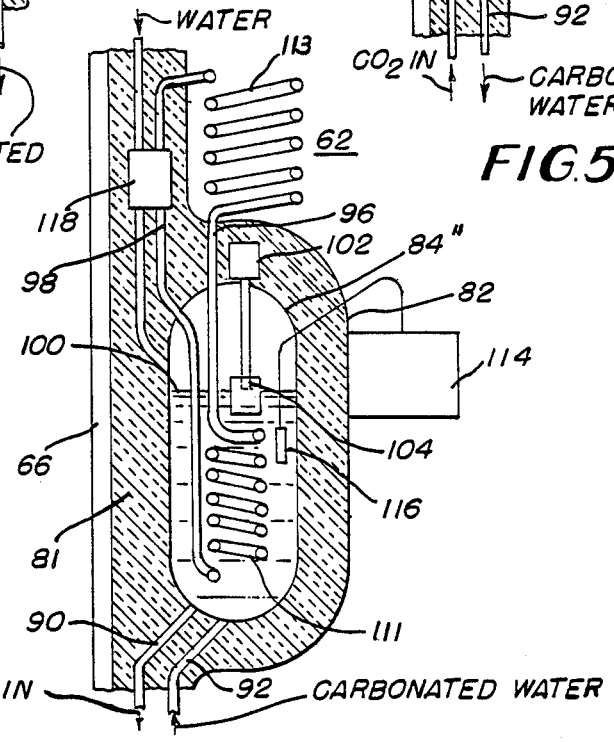
FIG. 6 is a partial cross sectional diagram of still another modification of the embodiment shown in FIG. 4.

Referring now to FIG. 6, the embodiment shown thereat comprises a liquid heat transfer system as opposed to a condenser-evaporator system and comprises a carbonator unit 84'' wherein a heat absorbing coil 111 is located interiorally of the carbonator 84'' while a heat dissipating or cooling coil 113 is located in the freezer compartment 62. What is significant about this embodiment is that an ice bank detector 114 having a sensing element 116 is located inside the carbonator 84'' for sensing the build up of an ice bank around the coil 111. The ice bank detector 116 is coupled to and controls a refrigerant circulator pump 118 connected in the tubing 96, 98 interconnecting the coil 111 with the coil 113.

In this embodiment the refrigerant flowing through the coils 111 and 113 remains liquid throughout the entire system. The liquid refrigerant warms up inside the carbonator 84'' as it travels through the coil 111 and cools down as it passes through the coil 113 in the freezer compartment 62. When a sufficient ice bank has built up, as determined by the ice bank detector 116, the recirculation pump 118 shuts off.

It should be noted that not only can the embodiment shown in FIG. 2 be used as part of a retrofit system, the three embodiments of a refrigeration system where the carbonator is encapsulated in a portion of the insulation of the freezer door as shown in FIGS. 4, 5 and 6 can be retrofitted as well, notwithstanding the fact that they could be implemented during original manufacture of the refrigerator.

The carbonator of the present invention is preferably operatively connected to a syrup supply system (not shown for clarity), which is also disposed in the refrigerator, in order to produce a post-mix carbonated beverage.

It should be noted that the foregoing detailed description has been made by way of illustration and not limitation. Accordingly, all modifications, alterations and changes coming within the spirit and scope of the invention are herein meant to be included.

What is claimed is:

1. Apparatus in a home refrigerator for dispensing a chilled carbonated liquid, said refrigerator having a freezer compartment and at least one external door mounted on the refrigerator, comprising:

heat exchanger means for cooling a carbonator and including a heat absorber and a heat dissipator;

said heat dissipator being thermally coupled to the interior of the freezer compartment, said freezer compartment thereby providing a heat sink for said heat dissipator;

said carbonator being located in said door and being thermally coupled to said heat absorber and being chilled thereby;

means for supplying a liquid to be carbonated to the carbonator;

means for feeding a carbonating gas to said carbonator; and means coupled to said carbonator and being located in said door for dispensing a carbonated liquid therefrom.

2. The apparatus of claim 1 wherein said heat dissipator is located in said freezer compartment.

3. The apparatus of claim 2 wherein said heat absorber and said carbonator comprise a composite structure located in said door.

4. The apparatus of claim 3 wherein said refrigerator additionally includes a refrigeration compartment and another external door, said doors providing respective external doors for said freezer compartment and said refrigeration compartment, and wherein said composite structure is located in said door for said refrigeration compartment.

5. The apparatus of claim 3 wherein said refrigerator additionally includes a refrigeration compartment and another external door, said doors providing respective external doors for said freezer compartment and said refrigeration compartment, and wherein said composite structure is located in said door for said freezer compartment.

6. The apparatus of claim 3 wherein said heat exchanger means comprises a closed cycle refrigeration system and wherein said heat dissipator comprises a condenser, said heat absorber comprises an evaporator and additionally including a pair of refrigerant conduits interconnecting the condenser and evaporator and wherein the condenser is located above said composite structure thereby causing a refrigerant to be gravity fed in a liquid state from said condenser to said evaporator by one of said conduits.

7. The apparatus of claim 6 wherein said evaporator comprises a liquid container for said refrigerant in a liquid state and wherein said carbonator is located within said liquid container.

8. The apparatus of claim 6 wherein said evaporator comprises a plurality of refrigerant conduit coils wound around said carbonator.

9. The apparatus of claim 6 wherein said evaporator comprises a plurality of refrigerant conduit coils located inside said carbonator.

10. The apparatus of claim 6 wherein said condenser comprises a plurality of refrigerant conduit coils located in said freezer compartment.

11. The apparatus of claim 6 wherein said condenser comprises a plurality of refrigerant conduit coils located in said freezer compartment and said evaporator comprises a plurality of refrigerant conduit coils located inside said carbonator.

12. The apparatus of claim 3 wherein said heat exchanger means comprises a liquid heat transfer system wherein a refrigerant remains liquid throughout the heat exchanger means and including a heat absorbing coil, a heat dissipating coil, a pair of refrigerant conduits and a refrigerant circulating pump coupled between said coils and an ice bank detector having a means located adjacent said heat absorbing coil for controlling said circulating Pump in accordance with the amount of ice built up around said heat absorbing coil.

13. The apparatus of claim 3 wherein said heat exchanger means comprises a constant temperature heat pipe including means at each end for respectively dissipating and absorbing heat.

14. The apparatus of claim 13 wherein said means at each end comprise heat transfer fins located in said freezer compartment and said carbonator respectively.

15. The apparatus of claim 3 and additionally including means for maintaining a predetermined level of liquid in said carbonator.

* * * * *